US006862340B2

(12) United States Patent
Wurzer

(10) Patent No.: US 6,862,340 B2
(45) Date of Patent: Mar. 1, 2005

(54) DEVICE FOR FILTERING A RAY BUNDLE

(75) Inventor: Gerhard Wurzer, Mantel (DE)

(73) Assignee: Siemens Aktiengesellschaft, Münich (DE)

( * ) Notice: Subject to any disclaimer, the term of this patent is extended or adjusted under 35 U.S.C. 154(b) by 126 days.

(21) Appl. No.: 10/290,886

(22) Filed: Nov. 8, 2002

(65) Prior Publication Data

US 2004/0013238 A1 Jan. 22, 2004

(30) Foreign Application Priority Data

Nov. 8, 2001 (DE) ..... 101 54 461

(51) Int. Cl.[7] ..... G21K 3/00
(52) U.S. Cl. ..... 378/157; 250/505.1
(58) Field of Search ..... 250/503.1, 505.1; 378/156–160; 359/887–892

(56) References Cited

U.S. PATENT DOCUMENTS 3,631,249 A * 12/1971 Friede et al. ..... 378/157
3,883,243 A * 5/1975 Weisglass et al. ..... 355/35
5,373,546 A 12/1994 Holzermer ..... 378/157
5,535,250 A * 7/1996 Seher et al. ..... 378/34
6,578,987 B1 * 6/2003 Hough et al. ..... 362/293

FOREIGN PATENT DOCUMENTS

DE OS 198 32 973 1/2000

* cited by examiner

*Primary Examiner*—Craig E. Church
*Assistant Examiner*—Thomas Artman
(74) *Attorney, Agent, or Firm*—Schiff Hardin LLP

(57) ABSTRACT

A device for filtering a ray bundle of electromagnetic radiation, particularly an X-ray bundle has different filter stages, produced by multiple filters that can be adjusted into the ray bundle, a drive for moving the filters, and separate arms for moving each of the filters. The respective first ends of the arms engage at the appertaining filter and the respective other ends thereof are chargeable with a force generated by the drive. Dependent on the motion of the drive, each of the filters can either be set into the beam path by charging the appertaining arm with an actuating force or can be retrieved from the ray bundle by charging the arm with a restoring force. A dog driven by the drive is able to be brought into contact with two detents respectively present at each of the arms. An IN detent is provided for charging the arm with the actuating force and an OUT detent is provided for charging the arm with the restoring force. For mechanical encoding of the arms, each arm has a position of the IN detent and a position of the OUT detent that differ from arm-to-arm.

17 Claims, 3 Drawing Sheets

DEVICE FOR FILTERING A RAY BUNDLE

BACKGROUND OF THE INVENTION

1. Field of the Invention

The present invention is directed to a device for filtering a ray bundle of electromagnetic radiation, particularly an X-ray bundle, of the type having different filter stages with multiple filters that can be adjusted into the ray bundle, a drive for moving the filters and having a separate arm for each filter, a first end of each arm engaging at appertaining filter and the other end thereof being chargeable with a force generated by the drive.

The invention is also directed to an assembly having a depth-of-field diaphragm arrangement for a medical X-ray system.

2. Description of the Prior Art

In a medical X-ray apparatus, the "quality" of the radiation, i.e. the energy distribution of the X-ray quanta, is significantly defined by filtering in addition to the voltage at the X-ray tube. Above all, low-energy quanta that do not significantly contribute to the imaging, and lead only to an unnecessary exposure of the patient to radiation, are to be eliminated by filtering the X-rays. The center of gravity of the energy distribution is shifted toward higher values by the filtering—the radiation is "hardened". Aluminum and—given higher-energy radiation—copper are frequently employed filter materials.

Copper pre-filters with different filter stages, i.e. with different absorption values, are particularly required for cardiological examinations.

A filter changer with different filter stages is disclosed by German OS 198 32 973. In order to be able to introduce more than two different filters (for example, filter A, filter B, filter C) into the beam path, a separate electromagnet must thereby be present for each filter, which leads to a complicated design that is susceptible to malfunction. An advantage of the filter changer of German OS 198 32 973 having respective, separate drives is that the filters can be introduced in combinations into the beam path (for example, filter A+filter C).

German PS 42 29 319 discloses another filter changer having a number of filters that can be introduced into the ray bundle and that are different from one another. Only a single motor is required for introducing the filters. The filters can be successively introduced into the ray bundle against the force of spring elements by rotation of a shaft driven by the motor. The return movement ensues due to the force of the spring elements. Separate switches are required and are present for holding the filters in the beam path against the spring force, the switches switching the motor off after the appropriate filter is positioned in the beam path. In this filter changer, only one of the existing filters can be positioned in the beam path an any one time (for example, filter B after the resetting of filter A, filter C after the resetting of filter B). The number of filter stages thus is limited to the number of existing filters since combinations of the filters in the beam path (for example, filter A+filter C) are not possible.

SUMMARY OF THE INVENTION

An object of the present invention is to provide filter device with which a large number of different filter stages, i.e. stages having transmission characteristics that are different from one another, can be achieved with little apparatus outlay.

In a device of the type initially described, this object is inventively achieved by the drive providing a motion so that any of the filters can either be set into the beam path by charging its appertaining arm with an actuating power or can retrieved from the ray beam by charging the arm with a restoring force.

The filter device of the invention has the advantage that a large number of filter stages is possible using only a single drive because the filters can be adjusted into the ray beam both individually as well as in arbitrary combinations. This is achieved because the introduction of the filters as well as the retrieval of the filters are possible on a filter-by-filter basis by means of corresponding movements of the drive.

As used herein an "arm" means any element or mechanism for force transmission, for example a slide, a lever, a rod or an articulation.

In a preferred embodiment, a holder, particularly a latch or a magnetic coupling, is present for holding each of the filters in its position in the ray bundle. Advantageously, it is thus not necessary for the drive to generate a holding force for continuously holding the filter in the ray bundle.

An element, particularly a restoring spring, is preferably present for holding and/or returning each of the filters into its position outside the ray bundle. A further position is thus reproducibly defined in a simple way. The restoring spring also can promote disengagement or uncoupling of the corresponding filter from the aforementioned holder.

The holder for holding the filters in their position in the ray bundle, particularly the latches, are dimensioned such that the restoring force of the restoring springs is not sufficient by itself for a filter to exit that position, and such that a filter can exit the position and return to its position outside the ray bundle when the restoring force generated by the drive is additionally applied.

In a preferred development, the arms are differently mechanically coded for the introduction motion as well as for the return motion.

In another preferred embodiment, the arms are differently mechanically coded such that one filter as well as multiple filters can be set into the beam path dependent on predefined movements of the drive that differ from one another, and such that both one filter as well as a plurality of the filters can be retrieved from the ray bundle dependent on pre-defined, other movements of the drive that differ from one another. Given, for example, a first movement of the drive, one of the filters (A) is introducible into the ray bundle, and given a second movement of the drive, this filter together with a second filter (B) could be introduced as an alternative.

Preferably, all filters can be set into the ray bundle incrementally given increasing movement of the drive in one direction, and all filters can be retrieved from the ray bundle incrementally given increasing movement of the drive in the opposite direction.

With increasing movement of the drive in one direction, for example, a first filter (A) is first introduced into the ray bundle, then a second filter (B) is additionally introduced, then a third filter (C) is additionally introduced, etc., until all filters are in the ray bundle; and upon the beginning of a movement of the drive means in the opposite direction, one of filters is first retrieved and the other filters are also successively retrieved with increasing movement in this direction until there are no longer any filters in the ray bundle.

In a further preferred development, the filters can be retrieved from the ray bundle in the same sequence (A-B-C)

in which they can be set into the ray bundle (A-B-C), with the introduction and retrieval ensuing according to a first-in-first-out rule.

Further, the filter device of the invention is particularly advantageously fashioned with a dog driven by the drive, this dog being able to be brought into contact with either of two detents that are present at each of the arms. An IN detent is provided for charging the arm with the actuating force and an OUT detent is provided for charging the arm with the restoring force. The dog, which can be fashioned as a gearing or catch, provides the advantage that the arms need not be rigidly coupled to the drive, so that the drive can execute a second movement after the execution of a first movement and independently therefrom.

With the first movement, for example, three filters (A-B-C) are placed into the ray bundle, and one of the filters (A), for example the one introduced first, is retrieved with the second movement, so that a combination of two filters (B, C) remains in the ray bundle as filter stage.

A filter stage preferably is produced by the drive first being moved in one direction and subsequently moved in the opposite direction.

In another embodiment, the positions of the detents at different arms differ from one another for the mechanical coding of the arms.

The positions of the detents preferably differ from one another such that—particularly proceeding from overlapping arms—the dog successively comes into contact with all IN detents, i.e. one-by-one, with increasing movement of the drive in one direction, and comes into contact with all OUT detents one-by-one given increasing movement of the drive in the opposite direction.

In particular, it is possible to move the arms in the direction toward the latch with the arms being spatially offset from one another, i.e. particularly in a fanned arrangement, and to define which filter or filters proceed into the latch based on the extent of the movement. Given reverse movement, the extent of the movement makes it possible to define which filter latched by the drive or which of the latched filers is/are retrieved or "ejected".

In another preferred embodiment, the drive generates a rotary motion of the dog, and the actuating force and the restoring force are generated dependent on the rotational sense.

For a simple and rugged design, it is expedient for the detents at different arms to be defined by different angular positions, which the dog coming into contact with the IN detents given rotation in one direction and coming into contact with the OUT detents given rotation in the opposite direction.

In another preferred embodiment a control device is provided for operating the drive. The control device has a memory device in which codings for the arms that differ from one another and/or pre-defined movements of the drive that differ from one another are stored or can be stored. Preferably, movements are stored that must be implemented for the realization of different filter stages, i.e. for the introduction of a filter or a combination of multiple filters into the ray bundle. In particular, the stored movements can be read out electronically and are employable by the control device for setting a desired or selected filter stage. Alternatively, the codings of the arms can be stored and used by a software in order to calculate the respectively required movements of the drive and to correspondingly operate the drive.

The control device alternatively can be fashioned such that it constantly logs which filters are located in the ray bundle at the time and which are not. This provides the advantage that the necessary movements of the drive for setting a desired filter stage need not necessarily always be implemented proceeding from a defined initial position of all filters, for example all filters not in the ray bundle, thereby allowing faster motion sequences from one filter stage to another filter stage under certain circumstances. The respectively required motion sequences, for example, can be calculated by software. The travel commands for the drive derive therefrom.

The filter are, in particular, copper and/or aluminum filters or pre-filters.

The filters differing from one another are particularly characterized by different transmission values.

The above-described device of the invention is advantageously allocated in an assembly with a depth-of-field diaphragm arrangement. For example, the device of the invention and the depth-of-field diaphragm arrangement form a structural unit, for example with a common housing.

The above-described device of the invention preferably is employed for filtering the X-ray bundle emitted by an X-ray source and is a component of a medical X-ray system, particularly for cardiology.

DESCRIPTION OF THE PREFERRED EMBODIMENTS

Figure 1:
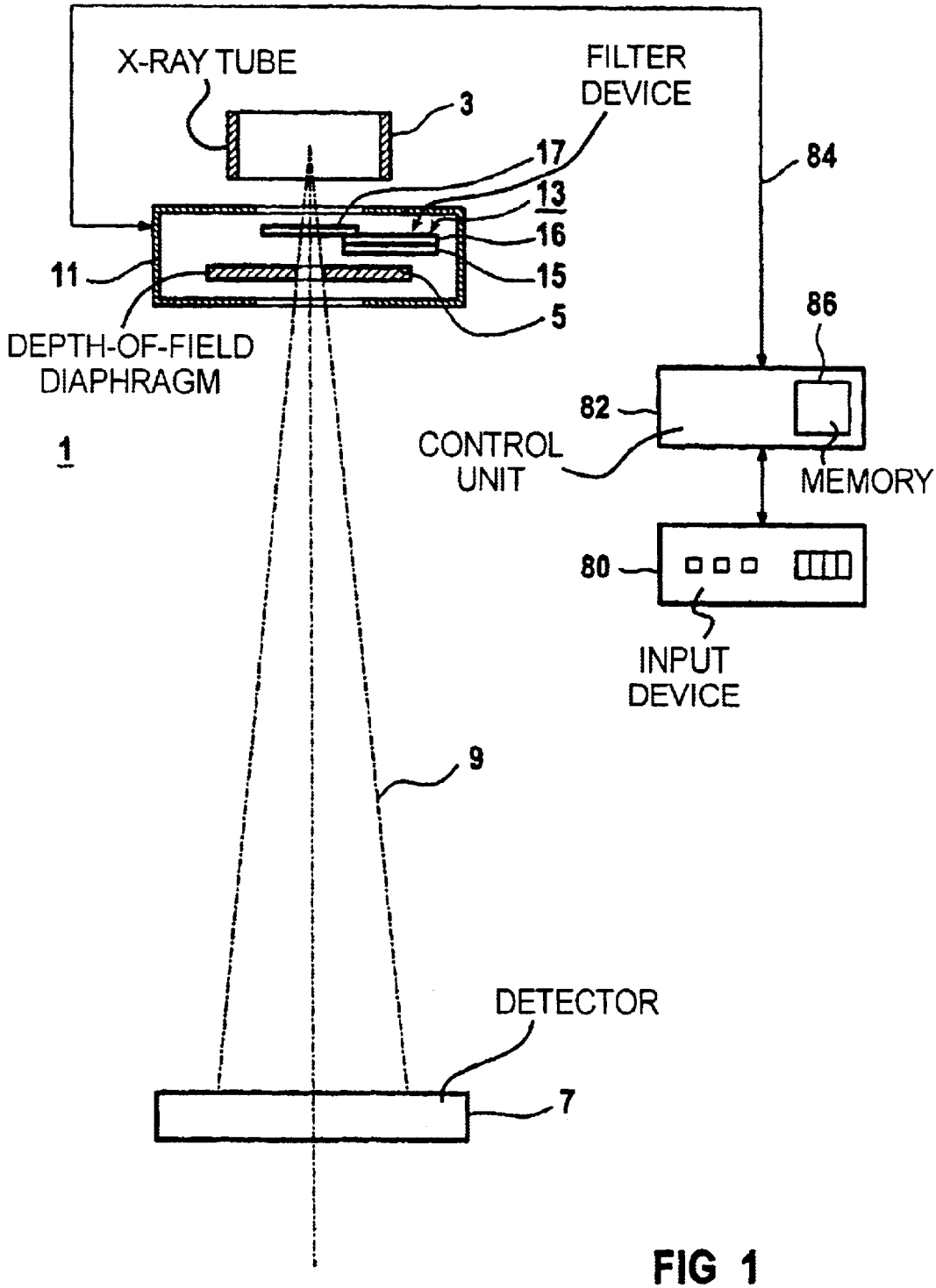
FIG. 1 schematically illustrates a medical X-ray system of the invention.

FIG. 1 shows a medical X-ray system 1 with an X-ray tube 3, a depth-of-field diaphragm arrangement 5 and a detector 7 for the registration of an X-ray image. The X-ray tube 3 emits an X-ray bundle 9 for the transirradiation of a patient (not shown).

A device 13 for filtering the X-ray bundle 9 is arranged between the X-ray tube 3 and the depth-of-field diaphragm arrangement 5 in a common housing 11 together with the depth-of-field diaphragm arrangement 5.

Figure 2:
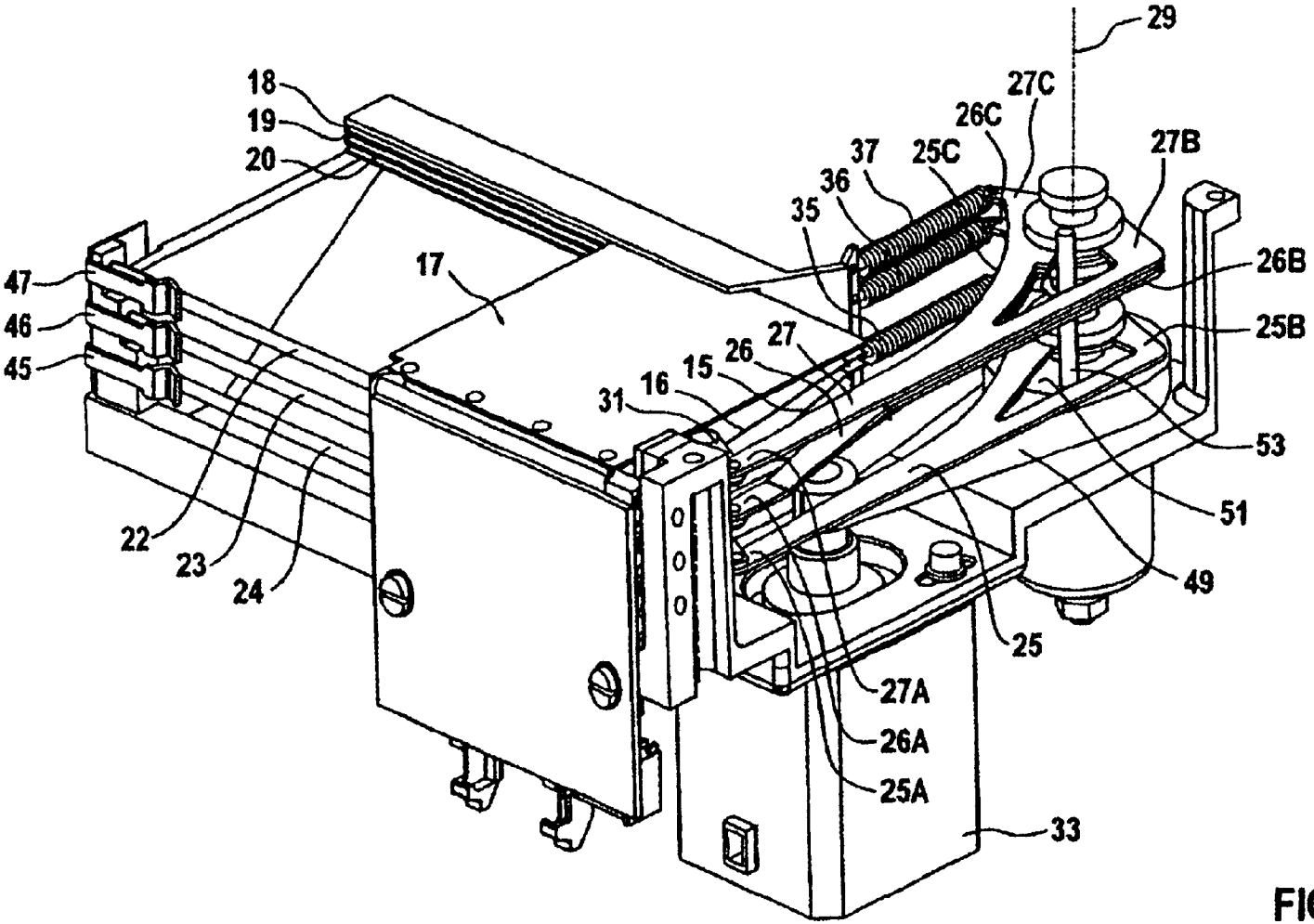
FIG. 2 illustrates a filter device of the invention in detail, shown in a perspective illustration.

The filter device 13 shown in detail in FIG. 2 has three copper plates of different thicknesses with thicknesses of 0.1 mm, 0.2 mm or 0.6 mm as three filters 15, 16, 17. The entire area of only the filter 17 adjustable into the uppermost plane is visible in FIG. 2. The two filters 15, 16 that can be linearly displaced in planes lying therebelow are only partially visible.

Each of the filters 15, 16, 17 can be positioned in a parked or OUT position—all three filters 15, 16, 17 are in this position in FIG. 2—as well as in an IN or active position wherein the filters 15, 16, 17 are in the path of the X-ray bundle 9. The filters 15, 16 and 17 preferably are rectangular or quadratic. For guidance of the filters 15, 16, 17, guides 18, 19, 20, each configured as a slot-shaped channel, are present at the one side of each of the filters 15, 16, 17, and a guide rail or guide rod 22, 23, 24 having a round cross section is present at the other side. Each filter 15, 16, 17 has a glider secured with screws or clamped, the gliders being is respectively movable along the guide rods 22, 23, 24.

Separate slide, links or arm 25, 26, 27 are present for respectively moving the filters 15, 16, 17, the respective first ends 25A, 26A, 27A of the filters engaging the appertaining filter 15, 16, 17. The respective opposite ends 25B, 26B, 27B of the filters are rotatably seated at a shaft 29. At the first end 25A, 26A, 27A, the arms 25, 26, 27 are rigidly connected to the appertaining filter 15, 16, 17 by, in each case, two hinges that are connected two one another via an articulation. The articulations (only the uppermost articulation 31 for the thickest filter 17 being visible in FIG. 2) compensate a relative motion between the respective ends 25A, 26A, 27A of the arm 25, 26, 27 and the filter 15, 16, 17 that is caused given swiveling of the arms 25, 26, 27.

Respective retrieval or restoring springs 35, 36, 37 engage third ends 25C, 26C, 27C of the arm 25, 26, 27, the filters 15, 16, 17 each being movable into the IN or active position opposite the restoring force produced by the associated spring. A drive 33 is provided for moving the filters, the drive 33 being fashioned as an electric motor that can rotate in both directions. By means of an actuating force generated by the drive 33, the filters 15, 16, 17 are adjustable into the IN or active position, i.e. into the X-ray bundle 9, against the spring force of the respective spring 35, 36 or 37.

Respective catch springs as latches 45, 46, 47, are present at the end of the guide rods 22, 23, 24 for each filter 15, 16, 17. The glider of the appertaining filter 15, 16, 17 is engageable into the latch when the appertaining filter 15, 16, 17 has reached its IN or active position in the X-ray bundle 9. This means that the drive 33 need not generate any retaining force in order to hold the filter 15, 16, 17 in the X-ray bundle 9. Each latch 45, 46, 47 is dimensioned such that the spring-based restoring force of the restoring springs 35, 36, 37 is insufficient by itself for overcoming the latching force of the latch 45, 46 or 47.

Each filter 15, 16, 17 can disengage its latch 45, 46 or 47 when the force of the respective restoring spring 35, 36, 37 is augmented by a restoring force generated by the drive 33, as explained in greater detail below. After leaving the influence of the restoring springs 35, 36, 37 ("unlatching"), the filter 15, 16, 17 is moved into the OUT position ("eject") only by the spring-based restoring force of the restoring springs 35, 36, 37. It is advantageous to provide damping means with which the accelerated arm 25, 26 or 27 is decelerated in the OUT position.

Via a belt 49, the drive 33 operates a turntable 51 that is rotatable around the shaft 29 and that is arranged under the second ends 25B, 26B, 27B of the arms 25, 26, 27. A cylindrical pin-like dog 53 that projects upwardly through recesses in the arms 15, 16, 17 is eccentrically secured to the turntable 51.

Figure 3:
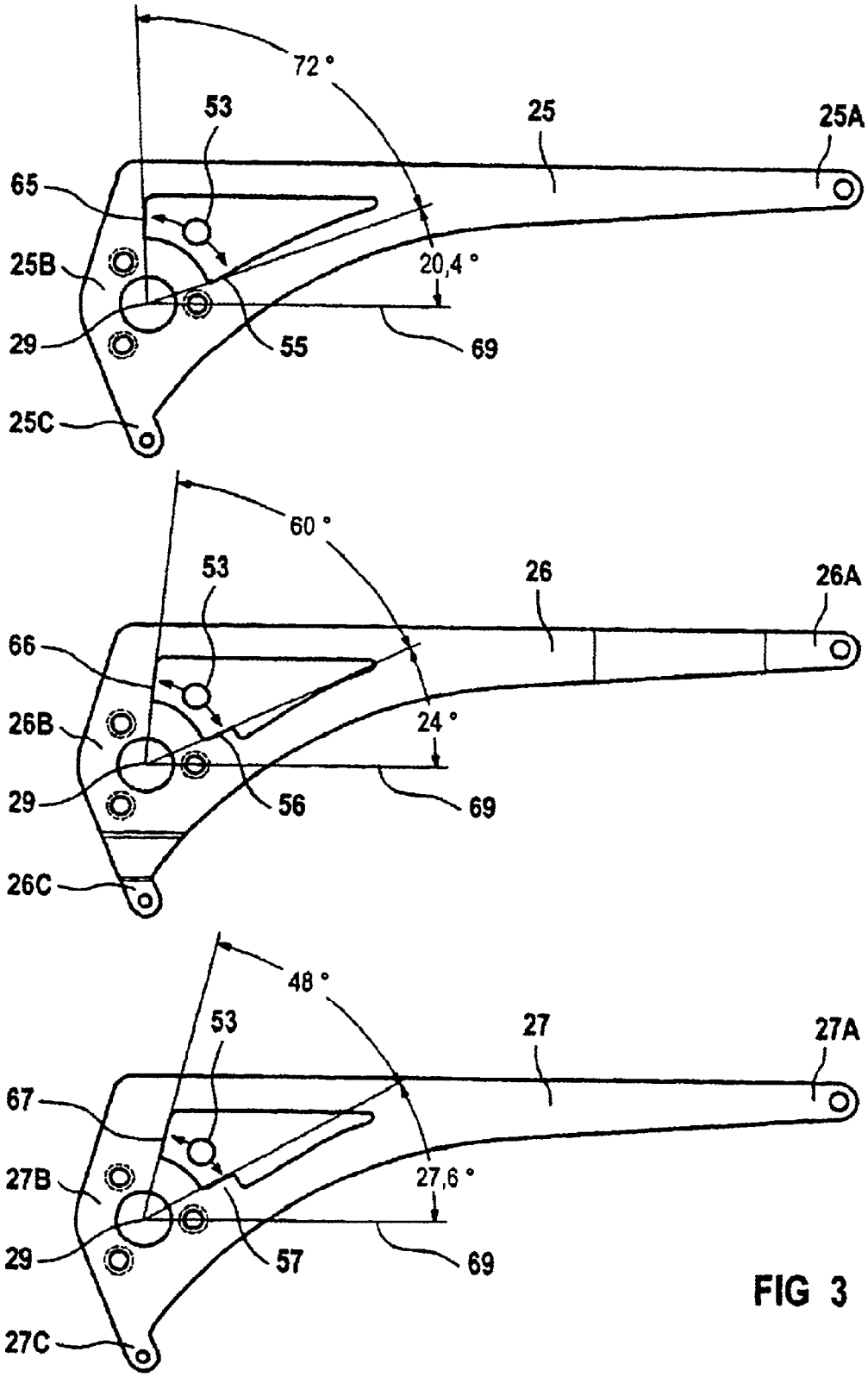
FIG. 3 shows the differently mechanically encoded arms of the filter device according to FIG. 2.

FIG. 3 is referenced for further description, which shows the arms 25, 26, 27 in their uninstalled condition lying next to one another and viewed from above. The inside edges of the recesses form detents 55, 56, 57, 65, 66, 67 for the rotatable dog 53. As defined IN encoding, each arm 25, 26, 27 has an IN detent 55, 56, 57 for charging the arm 25, 26, 27 with the actuating force, whereby the dog 53 moves clockwise upon entrainment of the appertaining arm 25, 26 or 27, and, as a defined OUT encoding, has an OUT detent 65, 66, 67 for charging the arm 25, 26, 27 with the restoring force, whereby the dog 53 thereby moves counter-clockwise upon entrainment of the appertaining arm 25, 26 or 27.

The arms 25, 26, 27 are essentially identical, i.e. congruent, with respect to their outside contour. They differ in the form of the respective recess in that the positions of the detents 55, 65, or 56, 66, or 57, 67 are different at each of the arms. With reference to an imaginary, shared axis 69 that proceeds parallel to the arms 25, 26, 27 and defines the OUT position of the filters 15, 16, 17 in the example, the angular position of the IN detents 55, 56, 57 increases in equal steps proceeding from the thinnest filter 15 (arm 25) to the thickest filter 17 (arm 27), and the angular position of the OUT detents 65, 66, 67 decreases in equal steps. The free angle aperture, i.e. the difference between the respective angular position of the OUT detent and the angular position of the IN detent, is greatest at the thinnest filter. It decreases steadily toward the thickest filter.

In detail, the angles amount to:

| Filter | Arm | IN detent | OUT detent | free aperture of the recess |
|---|---|---|---|---|
| 15 (0.1 mm) | 25 | 20.4° | 92.4° | 72.0° |
| 16 (0.2 mm) | 26 | 24.0° | 84.0° | 60.0° |
| 17 (0.6 mm) | 27 | 27.6° | 75.6° | 48.0° |

The function of the device 13 for an exemplary motion sequence shall now be explained. For this purpose, a initial condition is assumed wherein all arms 25, 26, 27—in the same angular position, i.e. overlapping as seen from above—are in the parked (standby) position. This condition is the condition shown in FIG. 3.

Given clockwise movement of the dog 53, it successively comes into contact with the IN detents 55, 56, 56, i.e. offset in time, namely first with the IN detent 57 of the arm 27 for the thickest filter 17. Given further rotation of the dog 53, this also comes into contact with the IN detent 56 of the arm 26 for the middle filter 16 and co-pivots this angle-offset by 3.6°. The same also occurs true for the arm 25 (IN detent 55) for the thinnest filter 15. Given further rotation of the dog 53, the arms 25, 26, 27 fanned in this way are then are moved synchronously farther against the forces of the restoring springs 35, 36, 37 until the foremost arm 27 has pivoted to such an extent that the thickest filter 17 has moved over a salient formed portion of threshold at the latch spring of the latch 47 ("latching"). The thickest filter 17 is set into the X-ray bundle in this condition. If no further filters are to be inserted, the dog 53 could now be moved back in the opposite direction. For explanation, however, it is assumed here that the other filters, 16 should be inserted, too. To this end, the dog 53 is moved farther in the same direction upon entrainment of all arms 25, 26, 27 until the middle arm 26 has also moved its filter 16 over the formed portion of threshold in the appertaining latch 46, i.e. latches. This motion is possible because each of the filters 15, 16, 17 is still movable beyond its formed portion or threshold, i.e. an overshooting is possible. The thickest filter 17, which has already engaged, therefore still can be entrained by the dog 53 by a specific path length (overshoot length) beyond its formed portion or threshold that is matched to the maximum angular difference between the IN detents 55, 56, 57 in order to also achieve a latching of the middle filter 16. Given further rotation of the dog 53 that proceeds beyond the latching of the middle filter 16, this [dog 53]—given synchronous continued motion of all arms 25, 26, 27 and potential utilization of corresponding overshoot lengths—also fixes the thinnest filter 15 in its latch 45 with the lowest arm 25. After this last filter 15 has moved beyond its shaped portion or threshold, the dog 53 can be moved in the opposite direction. Particularly the thickest filter 17 and the middle filter 16 likewise move in the opposite direction by their respective, current overshoot path distance until they remain at the respective shaped portion or threshold of their latch 45, 46, 47 (active position). In this condition, the arms 25, 26, 27 again lie over one another—mutually covering one another. From this moment, the dog 53 moves back without being in contact with the IN detents 55, 56, 57.

Retrieving the filters 15, 16, 17 from this condition wherein all filters 15, 16, 17 are in the active position and the arms 25, 26, 27 are congruent occurs in the same sequence by rotating the dog 53 counter-clockwise. After the dog 53 has lost contact with the IN detents 55, 56, 57, it first moves freely for some time. Then, it first comes into contact with the OUT detent 67 of the arm 27 for the thickest filter 17. As a result the thickest filter 17 is moved over its shaped portion or threshold ("unlatch") and, from then on, proceeds into the parked position only under the influence of its restoring spring 37 ("eject"). Given further rotation of the dog 53, it comes into contact with the OUT detent 66 of the arm 26 for the middle filter 16 and, last, comes into contact with the OUT detent 65 of the arm 25 for the thinnest filter 15. The filter 17, which is introduced first into the X-ray bundle 9, is thus also the first one "ejected".

With only the described movements, only the filter stages 0.6 mm, 0.8 mm (=0.6 mm+0.2 mm), 0.9 mm (=0.6 mm+0.2 mm+0.1 mm) given successive insertion and the filter stages 0.3 mm (=0.9 mm−0.6 mm=0.2 mm+0.1 mm) and 0.1 mm (=0.9 mm−0.6 mm−0.2 mm) given successive eject would be possible, i.e. 5 filter stages (without counting the unfiltered stage=0.0 mm). The last-cited two filter stages can be generated by the drive 33 is first being moved in one direction and subsequently being moved in the other direction.

Further filter stages can be produced by a change in the motion direction of the drive 33 already ensuing at a point in time at which not all filters are inserted into the X-ray bundle 9 (for example, for filter stage 0.2 mm) or/and by a change in the motion direction repeatedly ensuing (for example, for filter stage 0.7 mm).

Overall, the following filter stages that derive from the addition of the filter thicknesses are possible with the motion sequences indicated below:

| Filter stage (thickness in mm) | Motion sequence |
|---|---|
| 0 | |
| 0.1 | engage filters 0.6 mm, 0.2 mm, 0.1 mm<br>disengage filters 0.6 mm, 0.2 mm |
| 0.2 | engage filters 0.6 mm, 0.2 mm<br>disengage filter 0.6 mm |
| 0.3 | engage filters 0.6 mm, 0.2 mm, 0.1 mm<br>disengage filter 0.6 mm |
| 0.6 | engage filter 0.6 mm |
| 0.7 | engage filters 0.6 mm, 0.2 mm, 0.1 mm<br>disengage filters 0.6 mm, 0.2 mm<br>engage filter 0.6 mm |
| 0.8 | engage filters 0.6 mm, 0.2 mm |
| 0.9 | engage filters 0.6 mm, 0.2 mm, 0.1 mm |

It was assumed in the indicated motion sequences that the respective filter stage should be achieved proceeding from the filter stage 0 mm. Other motion sequences can derive proceeding from some other filter stage.

The required motion sequence is calculated by a software that runs in a control device 82 (see FIG. 1) for operating the drive 33, that is in communication with an input device 80 (see FIG. 1). The electronic-digital control device 82 acts on the drive 33 via a line 84. The control device 82 has a memory device 86 (see FIG. 1) in which the various encodings of the arms 25, 26, 27, i.e. the angular positions of the IN detents 55, 56, 57 and the angular positions of the OUT detents 65, 66, 67, are or can be stored. The software also stores the respectively current positions of all filters 15, 16, 17 proceeding from a reset position (all filters not in the beam path). The software determines the necessary motion sequence for the drive 33 dependent on a desired filter stage entered via the input device 80 and dependent on the momentary position of the filters 15, 16, 17.

All fundamentally possible, different filter stages, i.e. a total of eight, can be realized with only three different filters 15, 16, 17 as a result of the mechanical coding of the individual filter levels or: planes. The filter device 13 requires only little structural space and also allows very short filter changing times. The maximally needed time for changing from one filter stage to another filter stage amounts to approximately 0.6 sec.

Although modifications and changes may be suggested by those skilled in the art, it is the intention of the inventor to embody within the patent warranted hereon all changes and modifications as reasonably and properly come within the scope of his contribution to the art.

I claim as my invention:

1. A device for filtering a ray bundle of electromagnetic radiation, comprising:

a plurality of filters mounted for movement into and out of a ray bundle of electromagnetic radiation;

a single, non-pneumatic mechanical drive for moving said plurality of filters relative to said ray bundle;

a plurality of arms, equal in number to said plurality of filters, each of said arms having a first end engaging one of said filters and an opposite second end chargeable with a force generated by said drive;

said drive executing mechanical drive motions in different directions respectively for charging any of said arms with an actuating force to move the filter engaged therewith into said ray bundle and for charging any of said arms with a restoring force to remove the filter associated therewith from said ray bundle, for selectively moving one filter or multiple filters in said plurality of filters into said ray bundle; and wherein each of said arms has a different mechanical coding interacting with said drive allowing one or more said filters to be moved into said ray bundle by said drive dependent on respective predetermined movements of said drive that differ from each other, and allowing removal of said filters in said ray bundle dependent on respective predetermined, further movements of said drive that differ from each other.

2. A device as claimed in claim 1 further comprising a holder for mechanically holding each of said filters in said ray bundle after that filter has been moved into said ray bundle by said drive.

3. A device as claimed in claim 2 wherein said holder comprises a latch.

4. A device as claimed in claim 1 comprising a holder for holding each of said filters in a position outside of said ray bundle after that filter has been moved out of said ray bundle by said drive.

5. A device as claimed in claim 4 wherein said holder comprises a restoring spring.

6. A device as claimed in claim 1 wherein said drive engages said different mechanical codings to successively move all of said plurality of filters into said ray bundle one-by-one with increasing movement of said drive in a first direction, and for successively removing all of said filters from said ray bundle one-by-one with increasing movement of said drive in a second direction opposite to said first direction.

7. A device as claimed in claim 6 wherein said drive removes said filters from said ray bundle in a same sequence with which said filters were moved into said ray bundle by said drive.

8. A device as claimed in claim 6 wherein said drive moves said filters into said ray bundle and moves said filters out of said ray bundle according to a first-in-first-out rule.

9. A device as claimed in claim 1 wherein said drive produces at least one of said filter stages by first moving in a first direction and subsequently moving in a second direction opposite to said first direction.

10. A device as claimed in claim 1 wherein said mechanical coding at each of said arms comprises two detents, and wherein said drive comprises a dog movable into contact with either of said two detents of each arm, a first of said two detents at each arm being disposed relative to said dog to charge said arm with said actuating force and a second of said two detents being disposed for charging said arm with said restoring force.

11. A device as claimed in claim 10 wherein said two detents are respectively disposed at different positions in different arms of said plurality of arms, to form said mechanical coding.

12. A device as claimed in claim 11 wherein said detents on different arms are disposed relative to each other so that said dog successively comes into contact with all of said first of said two detents one-by-one with increasing movement of said drive in a first direction, and comes into contact with all of said second of said two detents one by one with increasing movement of said drive in a second direction opposite to said first direction.

13. A device as claimed in claim 10 wherein said drive rotates said dog in opposite rotational directions, and wherein said actuating force is produced by rotation of said dog in a first of said opposite directions and said restoring force is generated by rotation of said dog in a second of said opposite directions.

14. A device as claimed in claim 13 wherein the two detents of each arm are disposed at an angle relative to each other, said angle being different for each of said plurality of arms.

15. A device as claimed in claim 1 further comprising a control unit connected to said drive for operating said drive, said control unit having a memory in which at least one of said different mechanical codings and said different predetermined movements of said drive are stored.

16. An assembly for use with a ray bundle of electromagnetic radiation comprising:

a diaphragm for gating said electromagnetic radiation; and a filter device for filtering said electromagnetic radiation, comprising a plurality of filters mounted for movement into and out of a ray bundle of electromagnetic radiation, a single non-pneumatic mechanical drive for moving said plurality of filters relative to said ray bundle, a plurality of arms, equal in number to said plurality of filters, each of said arms having a first end engaging one of said filters and an opposite second end chargeable with a force generated by said drive; and said drive executing drive motions in different directions respectively for charging any of said arms with an actuating force to move the filter engaged therewith into said ray bundle and by charging any of said arms with a restoring force to remove the filter associated therewith from said ray bundle, for selectively moving one filter or multiply filters in said plurality of filters into said ray bundle;

wherein each of said arms has a different mechanical coding interacting with said drive allowing one or more said filters to be moved into said ray bundle by said drive dependent on respective predetermined movements of said drive that differ from each other, and allowing removal of said filters in said ray bundle dependent on respective predetermined, further movements of said drive that differ from each other.

17. A medical X-ray system comprising:

an X-ray source which emits a ray bundle of X-rays;

a radiation receiver disposed in said ray bundle for detecting said X-rays in said ray bundle for producing an x-ray image therefrom; and a filter device disposed between said X-ray source and said radiation receiver for filtering X-rays in said ray bundle, said filter device comprising a plurality of filters mounted for movement into and out of a ray bundle of electromagnetic radiation, a single, non-pneumatic mechanical drive for moving said plurality of filters relative to said ray bundle, a plurality of arms, equal in number to said plurality of filters, each of said arms having a first end engaging one of said filters and an opposite second end chargeable with a force generated by said drive; and said drive executing drive motions in different directions respectively for charging any of said arms with an actuating force to move the filter engaged therewith into said ray bundle and by charging any of said arms with a restoring force to remove the filter associated therewith from said ray bundle, for selectively moving one filter or multiply filters in said plurality of filters into said ray bundle;

wherein each of said arms has a different mechanical coding interacting with said drive allowing one or more of said filters to be moved into said ray bundle by said drive dependent on respective predetermined movements of said drive that differ from each other, and allowing removal of said filters in said ray bundle dependent on respective predetermined, further movements of said drive that differ from each other.

* * * * *